US006830107B2

(12) United States Patent
Allen

(10) Patent No.: US 6,830,107 B2
(45) Date of Patent: Dec. 14, 2004

(54) FLUID FLOW SWITCHING DEVICE

(75) Inventor: Anthony Allen, Scunthorpe (GB)

(73) Assignee: Ruff Pup Limited (GB)

( * ) Notice: Subject to any disclaimer, the term of this patent is extended or adjusted under 35 U.S.C. 154(b) by 0 days.

(21) Appl. No.: 10/427,470

(22) Filed: May 1, 2003

(65) Prior Publication Data

US 2004/0216883 A1 Nov. 4, 2004

(51) Int. Cl.[7] ..... E21B 34/14; E21B 33/12

(52) U.S. Cl. ..... 166/332.4; 166/334.4; 166/331; 166/386; 175/317; 175/324

(58) Field of Search ..... 166/312, 386, 166/331, 334.4, 332.4; 175/324, 317

(56) References Cited

U.S. PATENT DOCUMENTS 5,960,881 A * 10/1999 Allamon et al. ..... 166/291
6,039,117 A * 3/2000 Mueller ..... 166/312
6,607,607 B2 * 8/2003 Walker et al. ..... 134/18

FOREIGN PATENT DOCUMENTS

GB 2 340 524 A 2/2000
GB 2 351 511 A 1/2001

OTHER PUBLICATIONS

Search Report for corresponding British Application GB 0208764.1.

* cited by examiner

*Primary Examiner*—David Bagnell
*Assistant Examiner*—Shane Bomar
(74) *Attorney, Agent, or Firm*—Fay, Sharpe, Fagan, Minnich & McKee, LLP

(57) ABSTRACT

A fluid flow switching device for a drill string comprises a tubular member having a port (4). A sleeve member is slidable within the tubular member between a first position in which a port (3) thereof is in alignment with the port (4) and a second position in which the port (4) is obstructed. A plurality of fingers are connected to the sleeve member (2). Each finger defines one segment of a closure member that is closed when the fingers are pivoted inwardly and open when the fingers are pivoted outwardly. An operating surface is positioned within the tubular member, and the fingers are axially slidable thereover as the sleeve member is moved between the first and second positions to close and open the segmented closure.

6 Claims, 3 Drawing Sheets

FLUID FLOW SWITCHING DEVICE

Figure 1:
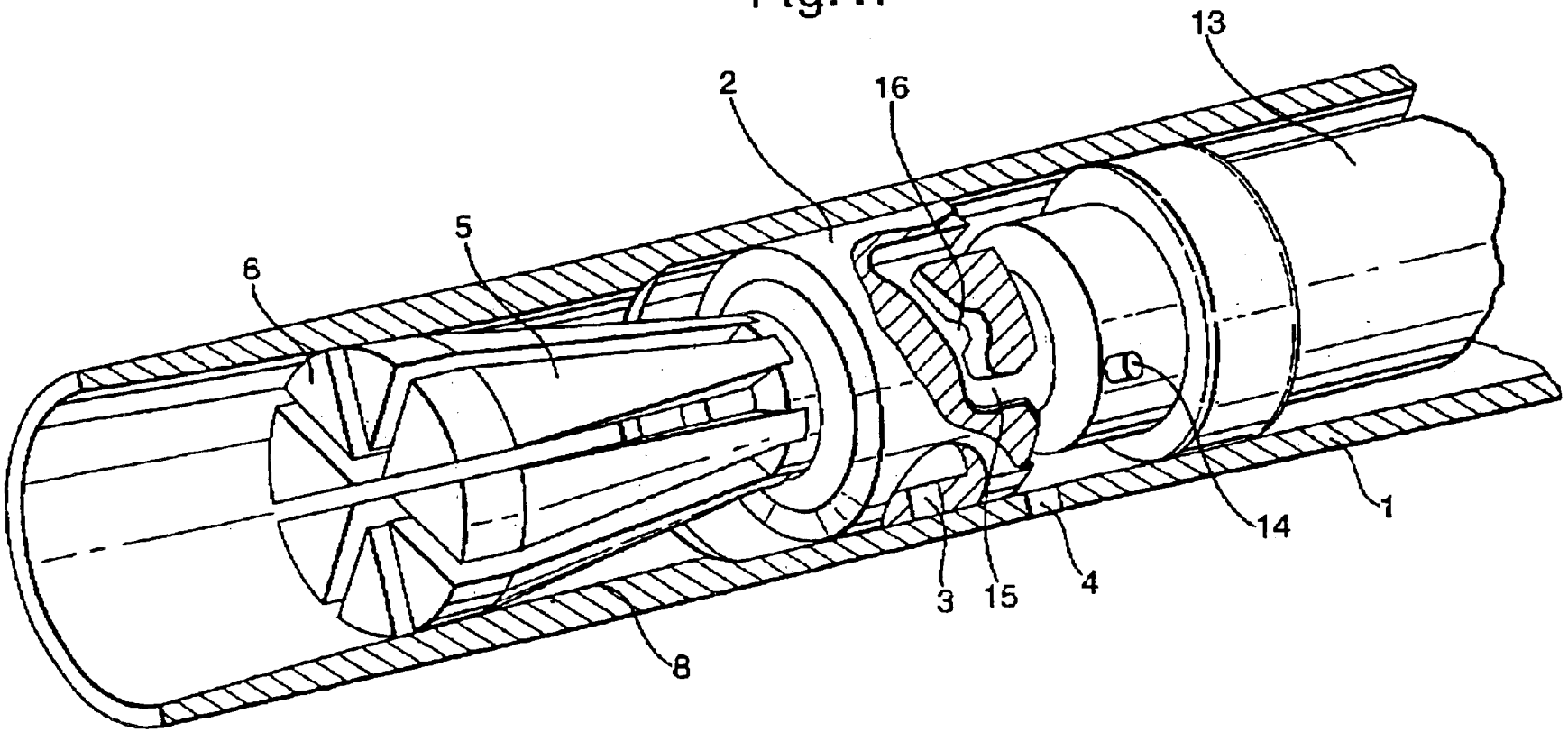

The present invention relates to a device for switching or diverting the flow of cleaning fluid in a drill string. In particular, the switching device allows cleaning fluid being pumped through a drill string to the lower sections of a well bore to be selectively diverted to the upper sections thereof.

Oil, gas, water and other types of wells are usually lined with a steel pipe or well to ensure the integrity of the well bore hole. From time to time during the working life of the well it is necessary to clean the internal walls of the well casing to remove debris and residues, such as oil, and scale, which have accumulated thereon. Various cleaning tools are known within the prior art for effecting a mechanical cleaning action on the internal walls of a well casing. Typically, these comprise brushes and/or scrapers mounted on a usually cylindrical carrier which can be connected to a drill string to drive the cleaning tool through sections of the well casing.

It is also known within the prior art to enhance the cleaning action of mechanical cleaning tools by introducing chemical agents into the well bore, either before or during the mechanical cleaning operation. These chemical agents attack and loosen the debris and residues attached to the well casing and thereby generally enhance the cleaning efficiency of mechanical cleaning tools.

In order to remove debris and residues loosened from the internal walls of the well casing it is known in the prior art to circulate cleaning fluid from the surface of the well down through the drill string carrying the mechanical cleaning tool, out into the annular space between the well casing and the drill string, and then back to the surface. This circulating cleaning fluid flushes the debris and residues loosened from the well casing back up to the surface where they can be filtered out and removed.

In order maximise the cleaning efficiency of chemical cleaning agents it is necessary for the cleaning fluid circulating through the well bore to be in turbulent flow. The degree of turbulent flow within a well bore is a function of the diameter thereof. It is not unusual for the internal diameter of a well bore to be larger at the top or mouth than it is in the lower reaches thereof. It follows that the flow rate required to achieve turbulent flow will be reached in the lower, narrower sections of the well bore well before it is reached in the upper, wider sections thereof. This can create problems, particularly where the fluid pumping equipment at the surface is operating at or close to its maximum pumping pressure in order to circulate fluid through the well bore fast enough to achieve turbulent flow in the lower reaches thereof. Put simply turbulent flow will not be achieved in the upper, wider section of the well bore.

It is an object of the present invention to provide a fluid flow switching device which enables an operator to selectively divert the flow of clearing fluid being pumped through a drill string to an outlet in the switching device.

According to the present invention there is provided a fluid flow switching device for use in a drill string comprising a tubular member or pipe adopted in use to be connected at each end to a respective section of a drill string so as to be continuous therewith, a sleeve member axially slidable within the tubular between a first upper position in which a port in the side thereof is in alignment with a port in the side of the tubular member and a second lower position in which the port in the side of the tubular member is obstructed and closed by the sleeve member, a plurality of fingers each of which is pivotably connected at one end to the lower end of the said sleeve and which at the other end defines one segment of a segmented circularly closure member, the segmented closure member being closed when the fingers are pivoted radially inwardly to bring the segments together and being open when the fingers are pivoted radially outwardly to separate the segments, and an annular operating surface positioned within the tubular member beneath the sleeve member, which annular operating surface diverges radially outwardly from the upper end thereof towards the lower end thereof and over which the said plurality of fingers are axially slidable as the sleeve member is moved between the said first upper position, wherein each of the plurality of fingers is biased radially inwardly causing the segmented closure member to obstruct the tubular member, and the said second lower position, wherein each of the plurality of fingers is biased radially outwardly causing the segmented closure member to open.

Preferably, each of the said plurality of fingers is biased radially outwardly thereby ensure that the said segmented closure member is normally in an open position.

Preferably, the fluid flow switching device further comprises a swivel piston mounted in the tubular member for engagement with the said sleeve member to move the said sleeve member between the upper and lower positions. Conveniently, the swivel piston comprises a bayonet fitting having at least one pin and the sleeve member defines at least one slot with which the said at least one pin engages and travels through to move the sleeve member from the second lower position to the first upper position and then back to the second lower position In use the fluid flow switching device is connected into a drill string at a point along its length which ensures that when the drill string is located in a well bore the device itself lies in the region of the upper, larger diameter section of the well bore. Now, to achieve turbulent flow in the upper, wider diameter section of the well bore, the fluid flow switching device is operated to close the flow of cleaning fluid into the section of the drill string connected below the device, and thence to the lower, narrower sections of the well bore, and to open the port in side of the device such that cleaning fluid is vented directly into the upper, larger diameter section of the well bore. Since the cleaning fluid is vented directly into this larger section the pump pressure required to achieve turbulent flow is reduced (when compared with that required when the cleaning fluid has first to be pumped past the narrow section). Thus, it is possible to achieve turbulent flow within the larger section without exceeding maximum pumping pressure limits.

Figure 2:
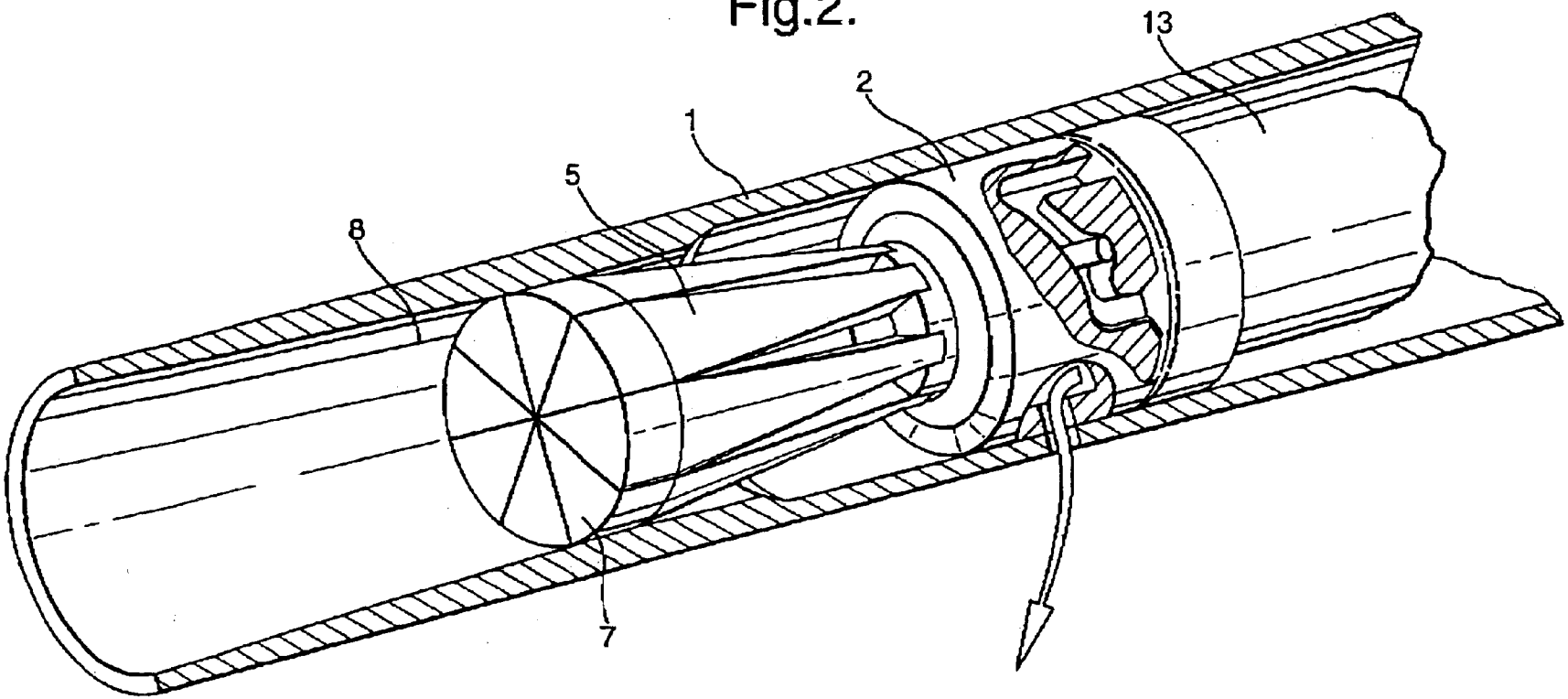
Figure 3:
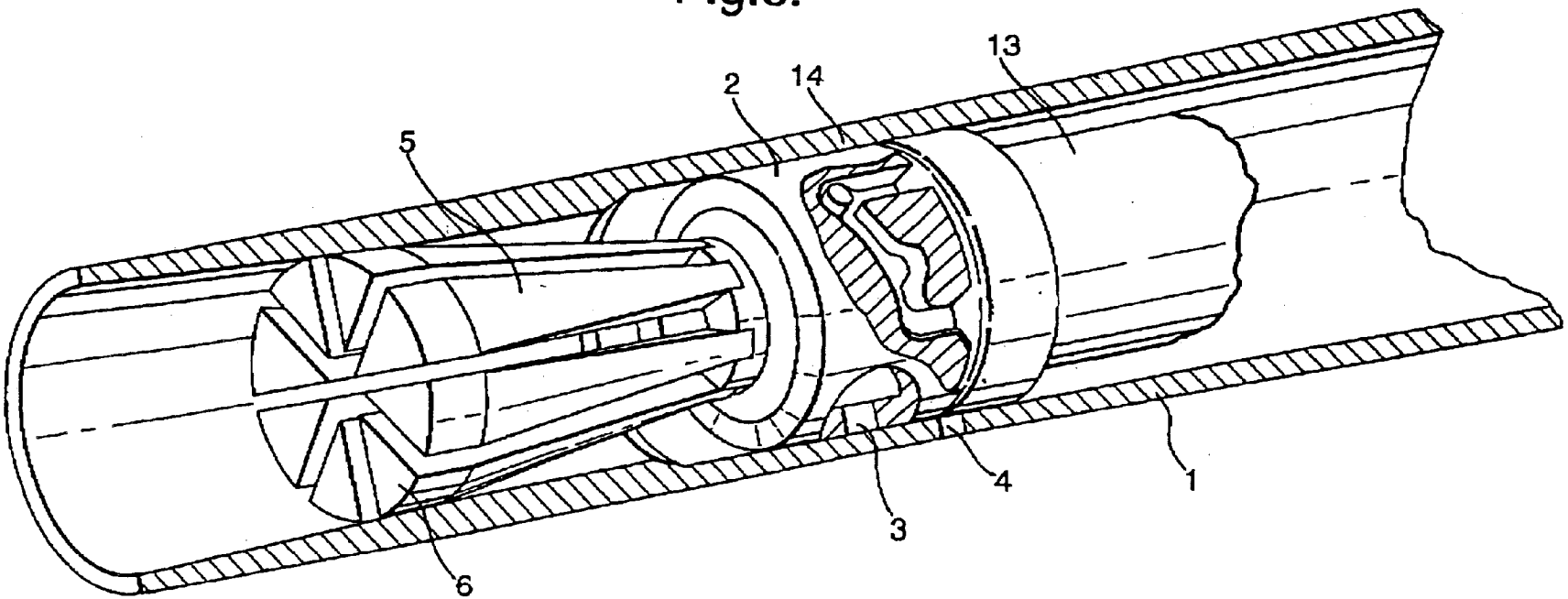

An embodiment of the present invention will now be described, by way of example, with reference to the accompanying drawings, in which:

FIG. 1 shows a schematic view of a fluid flow switching device according to the present invention in an open position to allow the flow of fluid therethrough;

FIG. 2 shows a schematic view of the fluid flow switching dice shown in FIG. 1 in a closed position such that the flow of fluid therethrough is diverted through an outlet port in the side thereof; and FIG. 3 shows a schematic view of the fluid flow switching device shown in FIG. 1 after it has been returned from the closed position shown in FIG. 2 to an open position and immediately prior to the withdrawal of an operating piston.

Referring to FIG. 1 of the drawings there is shown a fluid flow switching device for use in a drill string (not shown) to divert cleaning fluid being pumped down the drill string to the lower reaches of a well bore out of the drill string at the level of the switching device. The device itself comprises an outer housing in the form of a tubular pipe 1 which is adapted to be connected at one end to an upper section of the drill string and at the opposite end to a lower section of the drill string. Here it should be noted that for ease of illustration the connection means provided at each end of the tubular pipe 1 have not been shown. The through bore of the tubular pipe 1 is continuous with that of the upper and lower sections of the drill string and as such cleaning fluid is able to flow freely therethrough, subject to the operation of the device as will be described later hereinbelow.

Housed within the tubular pipe 1 is a sleeve member 2 having an outlet port 3 in one side thereof. Depending from the lower end of the sleeve member 2 are a plurality of fingers 5 the lowermost ends of which each define a respective segment 6 of a segmented closure member 7. Each of the fingers 5 is pivotable radially inwardly and radially outwardly about its connection to the sleeve member, but is normally biased outwardly by resilient biasing means such as a spring clip or the like (not shown). The sleeve member 2, together with the fingers 5, is axially slidable within the tubular member between a first lower position shown in FIG. 1 and a second upper position shown in FIG. 2. This axial movement of the sleeve member 2 causes the fingers to ride over an outwardly flared internal surface 8 of the tubular pipe 1 which causes the fingers to move radially outwardly or radially inwardly depending on their axial position on the said surface.

When the sleeve member 2 is in a first, lowered position, shown in FIG. 1, within the tubular pipe 1 the segments 6 carried by the fingers 5 lie at the bottom of the flared surface 8 where the internal diameter is largest. In this position the resilient biasing associated with the fingers 5 causes them to be biased radially outward and the segments 6 forming the segmented closure member to be separated. In this position a path is defined between the segments 6 for the passage of cleaning fluid through the tubular pipe 1. It should also be noted that in this first lowered position outlet port 3 in the side of the sleeve member 2 is obstructed and closed by the internal wall of the tubular pipe immediately adjacent thereto, thereby preventing any cleaning fluid from flowing therethrough.

When the sleeve member 2 is in a second, upper position, shown in FIG. 2, within the tubular pipe 1 the segments 6 carried by the fingers 5 lie at the top of the flared surface 8 where the internal diameter of the tubular pipe 1 is much reduced, and are thereby forced radially inwardly. This brings the segments 6 together and once they are all in tight engagement with each other the segment closure member 7 formed thereby is closed and forms an obstruction to the flow of cleaning fluid through the tubular pipe 1. It should also be noted that in this position the outlet port 3 in the side of the sleeve member 2 is aligned with a corresponding outlet port 4 provided in the side of the tubular pipe 1. Thus the cleaning fluid which is no longer able to pass through the tubular pipe 1 into the lower section of the drill string connected thereto is now diverted out through the ports 3 and 4 into region of the well bore immediately adjacent thereto.

By selectively causing the sleeve member 2 to move up or down within the tubular pipe 1 it is possible to determine whether cleaning fluid is pumped to the lower reaches of a well bore or pumped out into the well bore at the level of the device itself.

In order to facilitate operation of the device according to the present invention a swivel piston 13 is provided having pins 14 (only one of which is shown) extending radially outwardly from the side thereof to form a bayonet fitting which is engageable with the sleeve member 2. A groove or slot 15 is formed in the internal wall of the sleeve member 2 for each of the pins 14 and as the pin travels through the slot the sleeve member is caused to move up and down. As shown in FIG. 1 the swivel piston 13 has not been engaged with the sleeve member 2 and hence it assumes its normal position at the lower end of the tubular pipe 1. When it is required to lift the sleeve member 2 the swivel piston 13 is lowered onto sleeve member so that each of the pins 14 in the side thereof engages in the slot 15. When each pin 14 teaches the bottom of the first vertical leg of the slot 15 the swivel piston 13 is rotated in the tubular pipe 1 to bring the pin into engagement with a notch 16 formed in a horizontal section of the slot Now the swivel piston 13 can be pulled upwardly to cause the sleeve member 2 to move upwards. When it is desired to release the sleeve member 2 to allow it to return to the lower end of the tubular pipe 1, the swivel piston 13 is again rotated to cause the pin to travel along a section of the slot 15 which is directed downwardly, which in turn causes the sleeve member 2 to move downwards, as shown in FIG. 3. At the end of this downwardly angled section of the slot 15 the pin 14 enters a vertical section of slot and can be withdrawn to leave the sleeve member in its normal position.

What is claimed is:

1. A fluid flow switching device for use in an associated drill string comprising a tubular member or pipe adapted to be connected at each end to a respective section of the associated drill string so as to be continuous therewith and having a port in the side thereof, a sleeve member axially slidable within the tubular member between a first upper position in which a port in the side thereof is in alignment with the said port in the side of the tubular member and a second lower position in which the port in the side of the tubular member is obstructed and closed by the sleeve member, a plurality of fingers each of which is pivotably connected at one end to the lower end of the said sleeve and which at the other end defines one segment of a segmented circularly closure member, the segmented closure member being closed when the fingers are pivoted radially inwardly to bring the segments together and being open when the fingers are pivoted radially outwardly to separate the segments, and an annular operating surface positioned within the tubular member beneath the sleeve member, which annular operating surface diverges radially outwardly from the upper end thereof towards the lower end thereof and over which the said plurality of fingers are axially slidable as the sleeve member is moved between the said first upper position in which each of the plurality of fingers is biased radially inwardly causing the segmented closure member to obstruct the tubular member, and the said second lower position in which each of the plurality of fingers is biased radially outwardly causing the segmented closure member to open.

2. A fluid flow switching device according to claim 1, wherein each of the said plurality of fingers is biased radially outwardly thereby ensuring that the said segmented closure member is normally in an open position.

3. A fluid flow switching device according to claim 2, wherein the fluid flow switching device further comprises a swivel piston mounted in the tubular member for engagement with the said sleeve member to move the said sleeve member between the upper and lower positions.

4. A fluid flow switching device according to claim 1, wherein the fluid flow switching device further comprises a swivel piston mounted in the tubular member for engagement with the said sleeve member to move the said sleeve member between the upper and lower positions.

5. A fluid flow switching device according to claim 4, wherein the swivel piston comprises a bayonet fitting having at least one pin and the sleeve member defines at least one slot in which the said at least one pin engages and travels through to move the sleeve member from the second lower position to the first upper position and then back to the second lower position.

6. A fluid flow switching device adapted for use in a an associated drill string, said device comprising:

a pipe adapted to be connected at each end to a respective section of an associated drill string so as to be continuous with said associated drill string, said pipe including a first port defined in a side thereof;

a sleeve including a second port defined in a side thereof, said sleeve axially slidable within the pipe between: (i) a first position in which said second port is in alignment with said first port; and, (ii) a second position in which the first port is obstructed and closed by the sleeve;

a plurality of fingers, each of which is pivotably connected at one end to a lower end of the sleeve and each of which comprises a segment of a segmented closure, said segmented closure being closed when said fingers are moved together and being opened when the fingers are moved apart;

an operating surface positioned within the pipe, said operating surface diverging radially outwardly from a first end thereof toward a second end thereof, and over which said plurality of fingers are slidable as the sleeve is moved between said first position and said second position, wherein said segmented closure member obstructs said pipe when said sleeve is located in said first position and said segmented closure is opened when said sleeve is located in said second position.

* * * * *